United States Patent [19]

Seragnoli

[11] 3,977,159

[45] Aug. 31, 1976

[54] MACHINE FOR WRAPPING CONFECTIONARY PRODUCTS

[75] Inventor: Enzo Seragnoli, Bologna, Italy

[73] Assignee: G. D. Societa per Azioni, Italy

[22] Filed: Nov. 8, 1974

[21] Appl. No.: 522,300

[30] Foreign Application Priority Data

Nov. 21, 1973 Italy ..... 3531/73

[52] U.S. Cl. ..... 53/234; 53/230

[51] Int. Cl.[2] ..... B65B 11/36

[58] Field of Search ..... 53/230, 234, 227

[56] References Cited

UNITED STATES PATENTS

| | | | |
|---|---|---|---|
| 2,603,047 | 7/1952 | Malhiot | 53/234 X |
| 2,875,567 | 3/1959 | Brook et al. | 53/227 X |

*Primary Examiner*—Leon Gilden

*Attorney, Agent, or Firm*—Robert E. Burns; Emmanuel J. Lobato; Bruce L. Adams

[57] ABSTRACT

An intermittently rotating wrapping head has a plurality of movable peripheric radial grippers carried in succession to halt at an infeed station in order to grasp individual products around which wrapping material has been folded in a U by an infeed channel. A wrapping track then fashions a 'soap' or 'diamond' wrap for this purpose, a pair of folding fingers is provided along the wrapping track, on opposite sides of the infeed channel. Each folding finger consists of a blade placed tangentially to the path described by the individual products as they move between the grippers of the wrapping head and of two plate shaped members positioned above the blade, spaced at a distance equal to the dimension of the individual products perpendicularly to the movement plane of the wrapping head. The folding finger upstream of the infeed channel reciprocates in time with the movement of the wrapping head so as to fold with its blade member the part or prong on one side of the U wrap and, at the same time, with its plate shaped members to fold the corresponding lateral zones of the wrapping material close to the product. The other prong in the U and the lateral zones thereto are folded in like fashion by the other folding finger, which is fixed. Below the fixed folding finger further folding means are provided to fold in succession the resulting upper and lower lateral flaps in a radial direction close to the products themselves.

6 Claims, 12 Drawing Figures

Fig. 1
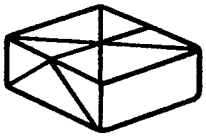
PRIOR ART
Fig. 2
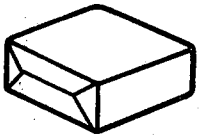
PRIOR ART
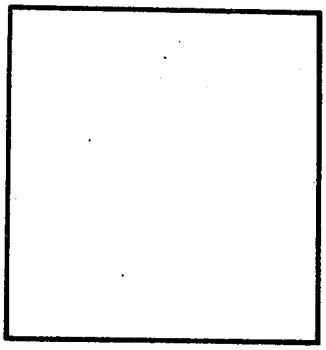
Fig. 3
PRIOR ART
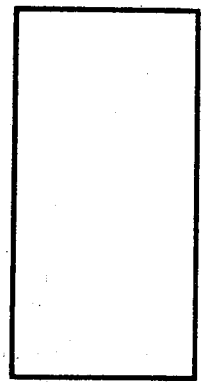
Fig. 4
PRIOR ART
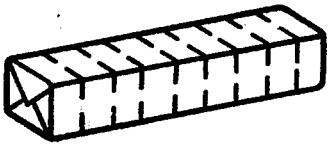
Fig. 12
PRIOR ART

MACHINE FOR WRAPPING CONFECTIONARY PRODUCTS

BACKGROUND OF THE INVENTION

This invention has as its subject an improved machine for wrapping products such as candies and chocolates, substantially of parallelepiped shape. The wrapped products are destined upon completion of the individual wrapping operation to make up, placed one after the other, batches of a predetermined number of products according to, for example, Italian Pat. No. 703.098 in the name of the same Applicants as herein.

Each of the said batches is then passed to a machine on which the edible and confectionery products forming the batch are given a common overwrap in order to form what is known as the 'stick.'

DESCRIPTION OF THE PRIOR ART

As is known, the outer wrap is normally made of metallized paper of a considerable thickness which is folded and sealed in such a way as to give the contents therein, in addition to mechanical protection, also adequate guarantees of a hygienic nature.

Again, according to the known technique, for the outer wrap of a "stick" use is made of what technicians in the industry call the 'soap' or 'diamond' style of wrap (see FIG. 12).

To wrap the individual products it is, instead, customary to use transparent thermoplastic material, wax paper or lined foil.

One characteristic called for by consumers and particularly appreciated by them is the possibility to quickly and easily free the products from their individual wrap.

In order that this requirement can be satisfied it is necessary to avoid sealing the wraps of the individual products or the inner wraps with glue or by means of a welding operation. In fact such sealing is unnecessary as the inner wraps have only the simple function of isolating each individual product from the other products with which it comes into contact, and to provide hygienic protection, particularly after the outer wrap has been opened, that is to say, once the products contained therein have started to be eaten.

The products are, therefore, simply wrapped individually in the wrapping material and, according to the known technique, they are given for this purpose what is known as the 'point' style of wrap (see FIG. 1).

Thanks to the choice of this particular wrapping style, inner wraps have been achieved which, besides satisfying the requirements of the public since they are unsealed, also possess characteristics which allow the various transfer phases to the machine on which the piles are formed and the outer wrap is put on to take place without any possibility of the said wraps opening up or becoming deformed.

However, in accordance with what will be described in detail hereinafter and can be seen from FIGS. 1 and 3, the type of wrap known as the 'point' wrap, used in the known technique, results in a considerable amount of wrapping material being consumed.

This consumption is far above that which would be needed to wrap the same product in, for example, what is known as the 'soap' or 'diamond' style of wrap. This will be hereinafter called the 'soap' wrap. With this latter style of wrap there is, as is known, a decrease of approximately 30% in the amount of wrapping material consumed (FIG. 4), compared with the amount required to wrap in the normally used 'point' style (FIG. 3).

Despite its obvious financial advantage, the 'soap' style of wrap has yet to get a foothold for wrapping the indicated products individually. This is due to difficulties experienced in achieving it on conventional wrapping machines.

For the customary 'point' wrap, a piece of material very much larger than the actual product is used. By contrast, for the fashioning of the 'soap' style of wrap, the piece of paper material used has to be of a size which just covers the product.

This, together with the fact that the products to be wrapped are of small size and the wrapping materials used often have a considerable amount of elasticity, necessitates the use of wrapping machines that are mechanically very precise. They must also provide a constant check on the wraps as they are being completed.

Nor must the check cease while the individual wrapped but not sealed products are transferred to the devices for forming the piles or "sticks" and attending to the outer wrap.

SUMMARY OF THE INVENTION

The main object of the present invention is, therefore, to make available an improved wrapping machine on which it is possible to individually wrap edible and confectionery products in the 'soap' or style.

A further object of the present invention is to make available a perfected wrapping machine of particularly simple structure.

These and other objects have been attained by using a channel for infeeding in succession the individual products to be wrapped; a track for the infeeding of the individual pieces of wrapping material at a speed timed to dovetail with the arrival of the individual products; a wrapping head having a plurality of movable peripheric radial grippers for grasping the individual products and the wrapping material applicable thereto; means for operating the wrapping head intermittently to cause the grippers to a position in front of the said infeed channel and subsequently, via one or more intermediary stations along a wrapping track, to an ejection station; means for moving in succession the products and the wrapping material applicable thereto along the infeeding channel and track until they are pushed in between the grippers positioned in the infeed station, with the wrapping material being folded in a U around the product. According to the invention the machine comprises a pair of folding fingers placed on the opposite sides of the infeed channel at a point corresponding to where the infeed station is located. Each folding finger in the pair consists of a blade placed tangentially to the path described by the individual products as they move between the grippers of the intermittently movable wrapping head, and of two virtually plate shaped members. These members are positioned above the blade, spaced apart to suit the dimension of the product in a direction perpendicular to the movement plane of the wrapping head, and of a height fundamentally identical to that of the product in the radial direction of the wrapping head. The folding finger upstream of the infeed channel with respect to the direction in which the wrapping head rotates is movable in a reciprocating fashion synchronously with the movement of the wrapping head so as to fold with its blade member the part or prong of wrapping material on one side of the U wrap and, at the same time, with its plate shaped members to fold the corresponding lateral zones of the wrapping material close to the product. At the same time the other prong in the U and the lateral zones thereof are folded in like fashion by the other folding finger, which is fixed. Folding means below the fixed folding finger are provided to fold in succession the resulting upper and lower lateral flaps in a radial direction close to the said product. Means moreover are provided to keep the product, wrapped in this way, guided from the last mentioned folding means up to the ejection station.

BRIEF DESCRIPTION OF THE DRAWINGS

Further characteristics and advantages will emerge more clearly from the following detailed description of a preferred form of embodiment for the machine according to the invention, illustrated purely as an non-limiting example on the accompanying drawings in which:

FIGS. 1 and 2 show, in a perspective view, an individual product wrapped in what is known as the 'point' wrap and the 'soap' wrap, respectively;

FIGS. 3 and 4 show, on the same scale as FIGS. 1 and 2, two known pieces of wrapping material pertaining to the wrapping style in FIG. 1 and to the wrapping style in FIG. 2, respectively;

FIG. 12 shows a batch of such products provided with a common outer wrap.

DESCRIPTION OF THE PREFERRED EMBODIMENT

Figure 5:
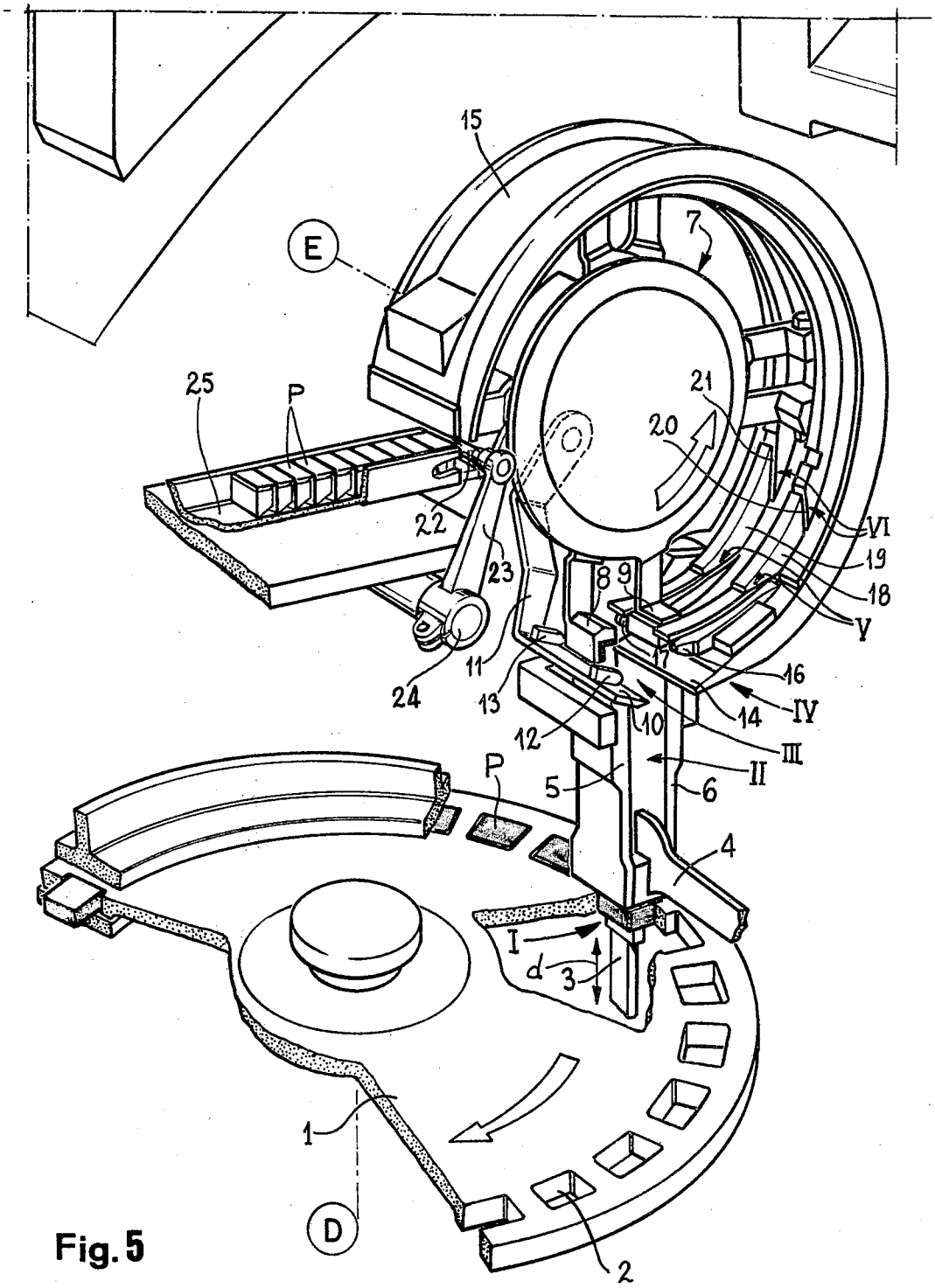
FIG. 5 shows, in a diagrammatic perspective view and partly broken away, the wrapping mechanism of the improved wrapping machine according to the invention.

With reference to FIG. 5, at 1 there is a circular conveyor plate mounted on a control vertical shaft and having a rim of rectangular peripheric holes 2. The plate is moved intermittently, about its center by suitable drive means D. Details are described in previous Patents in the name of the same Applicant as herein. Conveyor plate 1 supplies edible and convectionery products P (candies, chocolates, and the like), each generally of parallelepiped shape and, contained in one of the rectangular holes 2, to a position for transfer to the improved wrapping machine forming the subject of the present invention.

Figure 6:
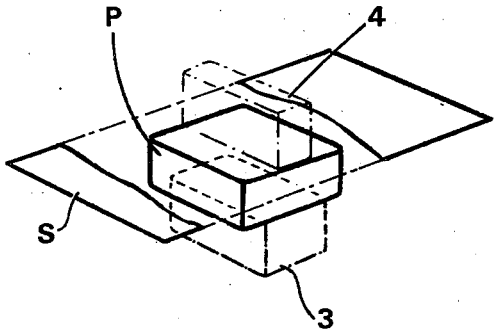
FIGS. 6, 7, 8, 9, 10 and 11 show, again in perspective views, six successive conditions of a products wrapped individually.

The product P contained in the hole 2 is, in the transfer position hereinafter referred to as position I, supported from the underneath by a vertical lifting member 3 which, every time the plate 1 is at a standstill and positioned for transfer of a product, is given a vertical outward and return movement, using means of a known type. Similarly, while the product P is in the aforementioned position I, a piece of wrapping material S is infed and positioned above the hole 2 in which the product P is contained (see FIG. 6).

The piece of wrapping material S is pressed against the upper side of the product P by a member 4, called the counter lifting member, which is provided with a reciprocating motion in a vertical direction synchronized with the movement of the lifting member 3. Thus, while the conveyor plate 1 is at a standstill, the lifting member 3 and the counter lifting member 4 take a tight grip on the product P and on the piece of wrapping material S and synchronously effect a vertical transfer travel thereof.

A channel, delimitated by two vertical parallel walls 5, 6 positioned as a continuation of the two tangential sides of the hole 2, serves, while this transfer is taking place, both as a guide and as a first folding member.

Figure 7:
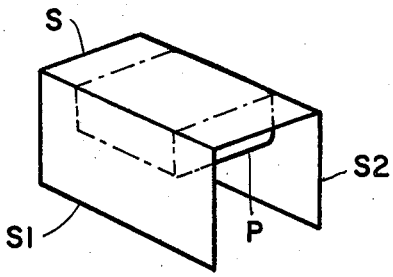

When the product P is expelled from the hole 2 and is inserted by the lifting member 3 into the channel 5, 6, it forces the piece of wrapping material S to hit against the two entrance edges on the walls 5 and 6 and to be progressively folded into an upside down U in position II, above position 1 (see also FIG. 7). For this purpose, as already indicated, the lifting and counter lifting members 3 and 4 are vertically moved up along the channel 5, 6, in direction *d*.

Upon completion of its vertical travel, the product P, around which the piece of wrapping material S has been partially wrapped, is inserted in what is called a wrapping wheel or wrapping head 7.

Wheel 7 consists of a cylindrical body intermittently rotatable in a counter clockwise direction as shown, through mechanical connections E of a known type, around a horizontal shaft parallel with the walls 5 and 6 of the guide channel and, furthermore, it is provided with four pairs of grippers 8–9, the arms of which stretch radially from the cylindrical body 7 and are enabled by suitable means, not shown, to adopt reciprocal converging and diverging positions.

The pairs of grippers are made to halt one after the other in line with the vertical path followed by the lifting member 3 with their arms forked in order to receive the product P therein. The lifting member 3 is at a standstill after having completed its upward travel, the pair of grippers 8–9 positioned in line with the feed-in path re-closes.

The ends of the arms of the grippers 8–9 attach themselves firmly, through the piece of wrapping material S, to the sides of the product P and to its upper part at the two sides of the zone held by the counter lifting member 4, thereby flattening the two flaps S1, S2 edges of the previously created U fold, FIG. 7.

At this stage, the lifting member 3, whose task is over, is free to commence its downward return travel towards the conveyor plate 1, while the counter lifting member 4 resumes its vertical climbing movement and detaches itself slightly from the top part of the product P.

Figure 8:
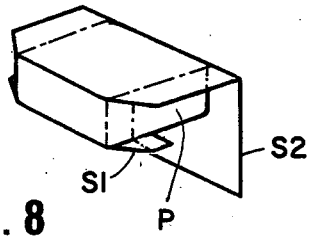

In the so established waiting position, or position III, further phases in the wrapping operation take place. The flap S1 on the piece of wrapping material S which protrudes radially below the left arm of the pairs of grippers 8–9 is folded (see FIG. 8), by an oscillating blade 10 integral with an arm member 11. This blade, during its outward oscillation, comes into contact on edge with the flap 51 and flattens it perpendicularly against the lower part of the product P. Two plate shaped folding members or teeth 12 and 13 integral with the upper side of the blade 10 then take care of a second operation contemporaneously and flatten the still projecting zones 51*a*, 51*b* of the left flap 51 of wrapping material S against the front and rear side of the product P.

While these wrapping phases are proceeding, the wrapping wheel 7 resumes its rotation in a counter clockwise direction.

Prior to the return oscillation of the blade 10, the flaps 2 on the piece of wrapping material S protruding along a radial plane below the right arm of the pair of grippers 8–9 is flattened on to the lower side of the product P, so that it is partially superimposed over the flap previously folded by the said blade 10. This is done by an entrance border or blade 14 on a guide 15 coaxial with the wrapping wheel 7 which stretches for approximately 270° from a position IV up to a station where the products P are ejected upon completion of the wrapping operations.

Figure 9:
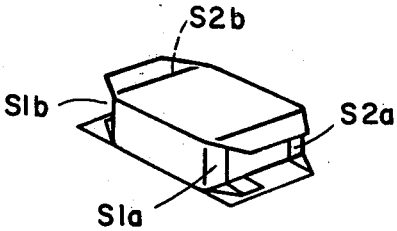

Still in position IV, the two zones 52*a*, 52*b* of the flap 52 of wrapping material S protruding from the two ends of the right side of the product P are, at the same time, folded against its front and rear side (see FIG. 9). This operation is carried out by two wedge shaped entrance extremities of two circular crown guides 16 and 17, integral with the internal cylindrical surface of the guide 15 but not attached thereto initially and stretching up to the ejection station.

Figure 10:
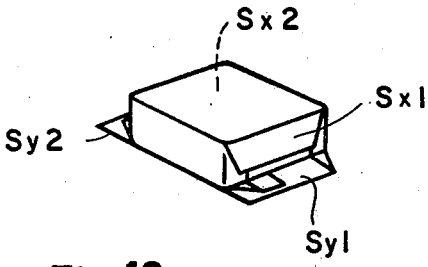
Figure 11:
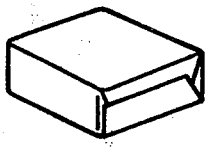

During the disengagement of the oscillating folding fingers or members 10-11-12-13, the product P, held tightly between the pair of grippers 8–9, is fully inserted into the channel delimitated radially by the coaxial guide 15 and, at the two sides, by the circular crown guides 16 and 17. In this process, the zones SX1, SX2 of the piece of wrapping material S yet to be folded slide above and below the guides 16 and 17, from the upper part of the product P and stretching above the two circular crown guides 16 and 17 are folded, during the rotation of the wheel 7, by two blades 18 and 19. These are so positioned, where there is an interruption in the continuity of the guides 16 and 17, that the protruding zones are progressively folded until they are flattened on to the front and on to the rear side of the product P, respectively, at a point corresponding to position V (see FIG. 10). Finally, the zones Sy1, Sy2 of the piece of wrapping material S protruding at the front and rear from the lower side of the product P which slide, as the wheel 7 rotates, along the coaxial guide 15 below the two circular crown guides 16 and 17, are subsequently folded upwards by two plate-shaped folding members 20 and 21. These are machined into the body of the guides 16 and 17 on blade and guide unit 14, 15. They are designed so that they progressively cause the lower protruding zones to come into close contact with the front and rear side of the product P in a position VI (see also FIG. 11).

In this way the wrapping operations on the wheel 7 are completed and the product P, duly enshrouded in its inner "soap" type wrap, arrives at a waiting station placed at 90° with respect to the entrance station.

Subsequently, following two forward movements punctuated by a waiting interval, the product reaches the ejection station which is placed at 270° with respect to the entrance station and here, as stated above, there is a break in the continuity of the coaxial guide 15 and of the circular crown guides 16 and 17.

In the ejection station, while the pair of grippers 8–9 re-open, a pusher member 22 pivoted through a connecting rod 23 to a shaft 24 parallel with the shaft of the wheel 7, engages from the rear, during its outward oscillation, with the product P enshrouded in its wrap, thereby releasing it from the hold of the grippers and causing it to slide on an exiting channel 25.

From channel 25 the products P, enshrouded in their wraps are, as previously stated, channelled towards devices where batches are formed, each out of a given number of products, and these batches are given a common outer wrap so that they are formed into what are called 'sticks' (see FIG. 12).

As can be seen from the description given herein, a fundamental characteristic of the improved machine according to the present invention is that during the various wrapping and transfer phases there is no interruption in the way in which the products are kept under control as the wraps are being formed and after their formation. As each set of mechanical members, folding fingers and guides completes its own particular task, other mechanical members take over without any break in continuity, to improve the folding operations and to avoid relative movement of the wrapping material and product,.

According to another characteristic of the invention, the various wrapping phases, as can be seen from FIG. 5, are completed in a small fraction of the total travel the product P undergoes on the wrapping wheel.

The relatively long period of time it takes the product P, already fully wrapped in the piece of wrapping material S to reach the ejection station is, therefore, completely utilized to smooth down and stabilize the wrap. If the wrapped products removed from the exiting channel 25 are not destined to be put into batches and to be overwrapped for the production of 'sticks' and thus the individual wraps need sealing, the above characteristic can be used to great advantage.

The long travel the products P undergo after the wrapping operations are over makes it possible, when glue is used to seal the products, to get it to dry properly. This can be speeded up with the use of heating elements (not shown) mounted on the fixed coaxial guide 15. Also, when heat sealing material is used for the wrap, it allows the welding operation to be properly effected.

In addition to the previously mentioned advantages of a considerable saving in wrapping material and the quick and easy way in which the consumer is able to unwrap products individually wrapped in the 'soap' or 'diamond' style, it should not be overlooked that in this particular field of production there is also an advantage of great productivity stemming from reduction of unproductive times for changing over used up reels of wrapping material with full ones being cut.

Indeed, if a use of of wrapping material measuring 56 millimeters for wrapping a product of given dimensions in the 'point' wrapping style (see FIGS. 1 and 3) requires replacing an empty reel with a new one every 40–50 minutes, assuming the reel to contain roughly 1,300–1,400 meters of material and to be used to wrap some 500 products per minute, then by contrast wrapping of the same products in the 'soap' or 'diamond' style (see FIG. 2), using reels that contain the same amount of material but of a width slightly greater and with pieces of wrapping material measuring 30 millimeters approximately (see FIG. 4), with the output speed of the wrapping machine again being in the region of 500 products per minute, a changeover only becomes necessary after approximately 90 minutes, thereby reducing by just about a half the down times for this particular operation.

What is claimed is:

1. A machine for wrapping confectionery products, comprising;

a wrapping head disposed to be moved intermittently in a rotary direction for wrapping individual confectionery products in individual pieces of wrapping material, one for each product;

means defining a channel for enabling delivery of the individual products, successively, to said wrapping head, to be wrapped; means defining a track for enabling delivery of the individual pieces of wrapping material, one for and with each individual product, to said channel and through it to said wrapping head in synchronism with the products;

a plurality of peripherally distributed grippers on said wrapping head, disposed to cooperate with said channel for gripping each delivered individual product and for bending the respective individual piece of wrapping material into a U-shaped configuration about the product, thereby providing U-flaps of said piece laterally of the product;

folding members located adjacent said wrapping head at points angularly spaced from said channel, disposed to wrap each gripped product in a "soap" style wrap by further folding of the U-flaps, and including a plurality of pairs of folding blades disposed tangentially of said rotary direction, and, for each blade, a set of plate shaped folding members secured to the blade, spaced apart distances equal to the dimension of the product in a direction perpendicular to the plane of said rotary direction, and having a height similar to that of the product, radially of the wrapping head, for said further folding of the U-flaps; and means angularly spaced from said folding members in said rotary direction for ejecting wrapped products from the grippers of the wrapping head.

2. A machine according to claim 1 in which the folding blades include a folding blade upstream of said channel in said rotary direction, disposed for reciprocating movement synchronous with the movement of said wrapping head to fold a part of each U-flap and, at the same time to enable the plate shaped members to fold corresponding lateral zones of the U-flap close to the product for said further folding of the U-flaps.

3. A machine according to claim 2 in which the folding blades also include means for folding final projecting zones of the wrapping material and U-flaps in directions radial of the wrapping head.

4. A machine according to claim 1 in which said plate shaped folding members are tapered towards their extremities which first come into contact with the wrapping material during said further folding.

5. A machine according to claim 1 in which every pair of folding blades includes a blade disposed for oscillating motion relative to said head.

6. A machine according to claim 1 in which said means for ejecting wrapped products is angularly spaced from said folding members by a major angular portion of the wrapping head, in said rotary direction.

* * * * *